United States Patent [19]

Sadler

[11] 4,019,267

[45] Apr. 26, 1977

[54] SKI BOOT STRUCTURE

[75] Inventor: Marc Sadler, Paris, France

[73] Assignee: Dorofix Design Establishment, Eschen, Liechtenstein

[22] Filed: Jan. 7, 1976

[21] Appl. No.: 647,149

[52] U.S. Cl. ..... 36/120

[51] Int. Cl.[2] ..... A43B 5/04

[58] Field of Search ..... 36/117, 120, 121

[56] References Cited

UNITED STATES PATENTS

| | | | |
|---|---|---|---|
| 3,686,778 | 8/1972 | Hornung | 36/120 |
| 3,698,106 | 10/1972 | Rieker | 36/121 |
| 3,721,023 | 3/1973 | Kastinger | 36/120 |
| 3,945,134 | 3/1976 | Ramer | 36/121 |

*Primary Examiner*—Patrick D. Lawson

*Attorney, Agent, or Firm*—D. Paul Weaver

[57] ABSTRACT

A ski boot upper is accurately produced by injection molding to form thereon a pair of trunnion elements properly positioned relative to the malleoli of the human anatomy. A leg component of the ski boot made conventionally has openings which pivotally receive neck portions of the trunnion elements, whereby proper articulation of the leg and upper are assured to enhance the comfort, convenience and mobility of the wearer.

3 Claims, 6 Drawing Figures

SKI BOOT STRUCTURE

BACKGROUND OF THE INVENTION

The invention relates to a ski boot in which a leg portion of the boot is coupled for pivoting or articulation with the boot upper, and to a process for manufacturing.

Ski boots are known in the art in which the leg is articulatedly coupled to the upper. The articulation joint on each side of the boot at the ankle is composed of a pair of bosses applied to the interior and exterior sides of the boot in proximity to the malleoli, and riveted to the upper.

A disadvantage of these known boots is the fact that the articulation bosses are not located exactly in alignment with the malleoli in order not to create disadvantages to the skier. Consequently, the articulation axis of the ski boot leg relative to the upper and the articulation axis of the human leg relative to the foot do not properly coincide, and this latter articulation is therefore rendered difficult and awkward.

A further disadvantage of the prior art is the fact that even though the bosses are displaced from the malleoli, the internal padding of the boot at the malleoli must necessarily be of reduced thickness in order not to give rise to an excessive transverse dimension of the boot, with the consequent impossibility of maintaining the skis in parallel side-by-side relation.

A further disadvantage is that, after prolonged usage, the bosses disposed inside of the boot cut and damage the interior padding, and because of the lesser padding thickness at the malleoli, the bosses can injure the skier's foot.

A final disadvantage, concerned with their manufacture, is that complex operations are required for attaching the leg of the boot to the upper, which can only be carried out in a factory by skilled personnel, and thus considerably increase the final cost of the boot.

According to the present invention all of the above disadvantages of the prior art are eliminated through the provision of a ski boot with its leg portion articulatedly coupled to its upper, wherein the upper is provided with a pair of mushroom-like appendages, bosses or trunnions on its opposite sides engaging pivotally into corresponding holes formed in the leg of the boot.

The boot upper, according to the invention, is constructed using conventional injection molding means by injecting a synthetic fluid material into a mold cavity, the lateral elements of which comprise impressions having cavities complementary to the mushroom-like appendages and arranged to form, joined together, the two front sides of the upper, then awaiting solidification of the material and, shortly before the latter is complete, forcibly withdrawing the two lateral elements of the mold, then separating the two front sides of the upper by cutting, and finally extracting an inner form, the leg portion being manufactured separately by conventional techniques.

Other features and advantages of the invention will become apparent during the course of the following description.

BRIEF DESCRIPTION OF DRAWING FIGURES

DETAILED DESCRIPTION

Figure 1:
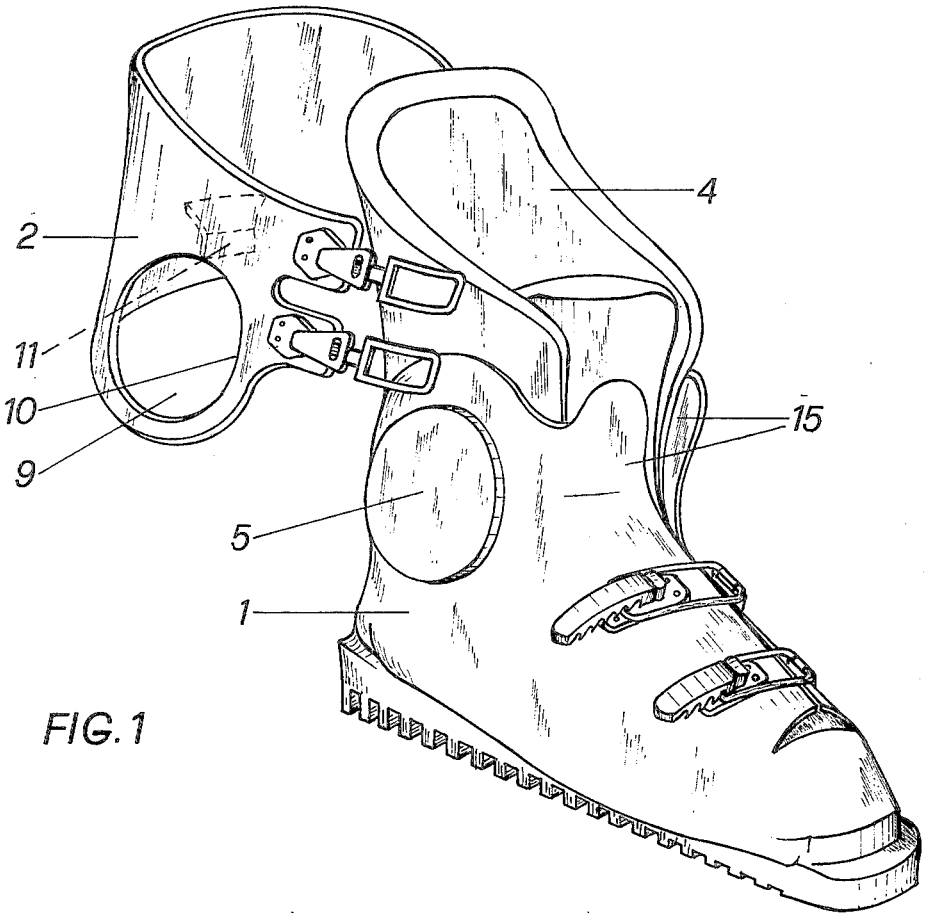
FIG. 1 is an exploded perspective view of a first embodiment of the invention.
Figure 2:
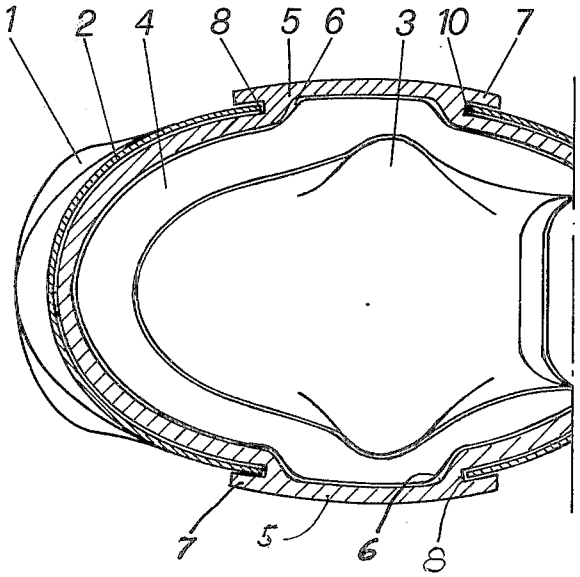
FIG. 2 is a partial horizontal section through the latter taken at the articulation axis of the leg and upper.

Referring to the drawings in detail wherein like numerals designate like parts, a ski boot according to the invention comprises a rigid outer upper part 1, a leg part 2 articulatedly coupled to the upper at the malleoli 3 of the skier, and a soft shoe 4, or padding, inserted in the outer upper and projecting above the upper, FIG. 1, to form padding for the leg above the ankle.

The outer upper 1 and boot leg 2 are both preferably constructed from synthetic material such as polyurethane, while the padding 4 is formed of conventional resilient material, such as polyurethane foam or other self-shaping deformable material, normally obtainable commercially.

The outer upper 1 comprises on both sides of the malleoli of the skier two cylindrical mushroom-like projections or trunnions 5, with corresponding cylindrical recesses 6 in the boot interior of size substantially greater than the diameter of the malleoli 3. The exterior flange 7 of each projection 5 lies parallel to the vamp of upper 1 to form therewith a circumferential groove 8.

The leg 2 of the boot is provided adjacent the projections or trunnions 5 with holes 9, the edges 10 of which engage exactly in the circumferential grooves 8, to allow relative rotation and flexure between the entire leg 2 and upper 1 about the common axis of the trunnions 5 and holes 9.

The rear of the boot, a hooked appendage 11, FIG. 1, provided on the interior of the leg 2, cooperates with the rear top edge of the upper 1, to keep both in the correct position of mutual engagement.

From the description above, the advantages of the boot according to the invention compared to traditional boots with articulated legs should be evident, and comprise:

1. Exact coincidence between the axis of rotation of the boot leg about the upper and the axis of rotation of the human leg about the foot, without the articulation movements of the latter being difficult;
2. Elimination of any metal element which might cut the inner padding or injure the skier's foot, and which in any case might oxidize with time and make articulation difficult;
3. Elimination of one element and one processing stage connected with the application of the latter, with the consequent possibility of obtaining more rapid and economical production; and
4. The ability of the skier to replace the leg of the boot with another of equal or different height, contour or color without having to return the boot to the factory.

Upper Manufacturing Process

Figure 3:
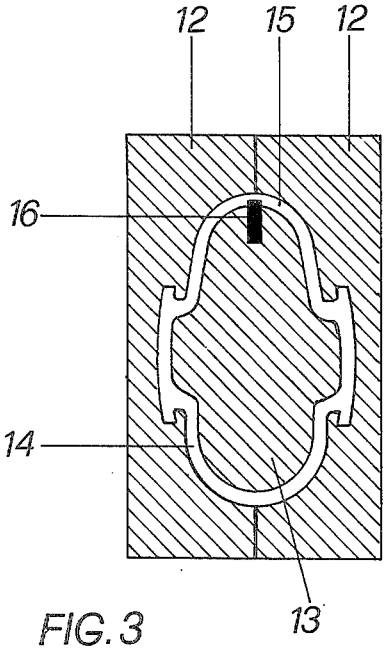
FIGS. 3, 4 and 5 are diagrammatic cross sectional views of three successive stages in the manufacturing process for the outer upper.
Figure 4:
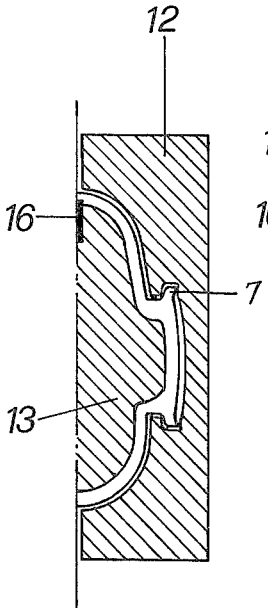
Figure 5:
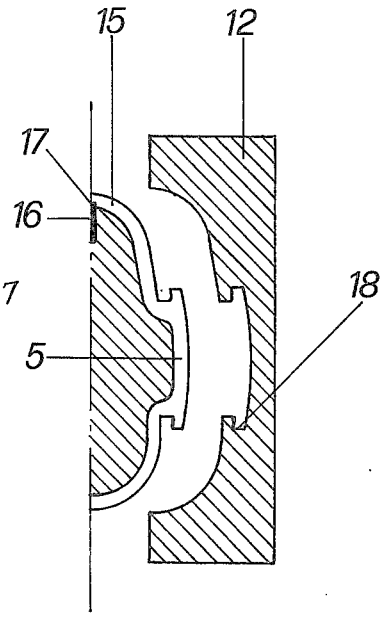

The boot upper 1, according to the invention, is manufactured using a traditional mold comprising two withdrawable lateral elements 12, FIGS. 3 to 5, an inner former 13, and a piston means, not shown. This assembly provides an interspace 14 which constitutes the negative of the molded article to be obtained.

The lateral mold elements 12 are shaped in such a way that the upper is obtained with its two front sides 15 joined together. A blade 16, partially projecting from the inner former 13, produces a groove 17 between the two sides 15 to facilitate their separation.

To obtain the boot according to the invention, the constituent material, polyurethane or the like, of the upper 1 is injected into the mold and shortly before it has completely solidified, the two lateral mold elements 12 are pulled apart so that the flanges 7 of trunnions 5 can withdraw from the corresponding seat 18 of elements 12, overcoming the undercut resistance induced by the flanges 7. Such flexure of the partly solidified elements 7 during mold separation is graphically shown in FIG. 4. Finally, the two front sides 15 of the upper are cut longitudinally to separate them by exploiting the weakness of the upper at the groove 17.

Figure 6:
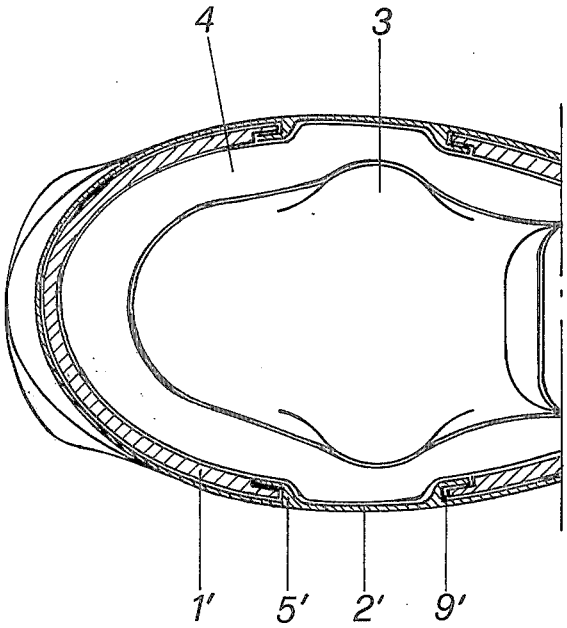
FIG. 6 is a horizontal cross section similar to FIG. 2 showing a modification of the invention.

In a modified embodiment of the invention diagrammatically shown in FIG. 6, the positions of the mushroom-like elements 5′ and coacting holes 9′ are reversed relative to the first embodiment, that is, the elements 5′ are carried by the leg portion 2′, and the holes 9′ are formed in the upper 1′. This embodiment has the advantage of enabling traditional molds to be adapted for the production of boots according to the invention. Except for the reversal of elements 5′ and 9′, all other parts in FIG. 6 remain identical in construction and operation to those corresponding parts previously described in the first embodiment.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ski boot comprising a boot upper and a boot leg portion articulatedly coupled with the boot upper at the natural articulation axis of the human ankle, and means forming an articulation connection between said upper and leg portion comprising rotationally engaged interfitting parts on said upper and leg portion at the interior and exterior sides of the ski boot and substantially at said natural articulation axis of the ankle, said means forming said articulation connection comprising a pair of flanged trunnions on the interior and exterior sides of said upper, and said leg portion being provided with a pair of opposite side openings receiving closely and rotatably said trunnions inwardly of the flanges of the trunnions, said upper and said trunnions being integrally formed from synthetic material and being substantially rigid, said trunnions being substantially cylindrical, and said openings of the leg portion being substantially circular.

2. A ski boot comprising a pair of articulatedly coupled parts, and means forming an articulation connection between said parts, said means comprising rotationally engaged interfitting elements on said parts, said rotationally engaged interfitting elements comprising at least one trunnion which has at least a partial flange on one of said parts and said trunnion being engaged with an opening in the other part closely and rotatably, said trunnion being formed integrally with said one part from synthetic material and being substantially rigid.

3. A ski boot as defined in claim 2, wherein said means forming said articulation connection between said parts comprises a pair of flanged trunnions of substantially cylindrical form on one part and a pair of opposite side openings of substantially circular form on the other part.

* * * * *